US005255650A

United States Patent [19]

Faletti et al.

[11] Patent Number: 5,255,650

[45] Date of Patent: Oct. 26, 1993

[54] ENGINE BRAKING UTILIZING UNIT VALVE ACTUATION

[75] Inventors: James J. Faletti, Spring Valley; Yung T. Bui, Peoria Heights, both of Ill.

[73] Assignee: Caterpillar Inc., Peoria, Ill.

[21] Appl. No.: 891,597

[22] Filed: Jun. 1, 1992

[51] Int. Cl.[5] ..... F02D 13/04

[52] U.S. Cl. ..... 123/322; 123/90.11; 123/323

[58] Field of Search ..... 123/90.11, 321, 322, 123/323

[56] References Cited

U.S. PATENT DOCUMENTS

| | | | |
|---|---|---|---|
| 3,786,792 | 1/1974 | Pelizzoni et al. | 123/321 |
| 4,572,114 | 2/1986 | Sickler | 123/21 |
| 4,592,319 | 6/1986 | Meistrick | 123/321 |
| 4,779,600 | 10/1988 | Asaga et al. | 123/568 |
| 4,930,463 | 6/1990 | Hare, Sr. | 123/321 X |
| 4,932,372 | 6/1990 | Meneely | 123/182.1 |
| 4,945,870 | 8/1990 | Richeson | 123/90.11 |
| 4,966,110 | 10/1990 | Seki et al. | 123/327 |
| 5,012,778 | 5/1991 | Pitzi | 123/321 |
| 5,036,810 | 8/1991 | Meneely | 123/321 |
| 5,048,480 | 9/1991 | Price | 123/321 |
| 5,086,738 | 2/1992 | Kubis et al. | 123/322 |
| 5,117,790 | 6/1992 | Clarke et al. | 123/321 |

FOREIGN PATENT DOCUMENTS

| | | |
|---|---|---|
| 3027415 | 2/1982 | Fed. Rep. of Germany . |
| 0230911 | 9/1990 | Japan . |
| 0705134 | 8/1979 | U.S.S.R. . |
| 2134596 | 8/1984 | United Kingdom . |

*Primary Examiner*—Tony M. Argenbright
*Attorney, Agent, or Firm*—Larry G. Cain

[57] ABSTRACT

Braking systems for use with internal combustion engine have in the past used a variety of mechanical mechanisms to activate the braking system in addition to the conventional cam, lifters, pushrods and rocker arms. Many of these systems fail to provide the option of controllably and modulatively varying the sequence and amount of the opening and closing of an intake or exhaust valve relative to a piston position in a cylinder bore. The present invention provides an electronic control system outputting an discrete control signal, an opening device for unit actuation of each of the pair of valves independently. The electronic control system is programmable to respond in a first predetermined logic pattern for conventional operation of the engine at which time each of the pair of valves are in the closed position during the compression stroke. The electronic control system is programmable to a second predetermined logic pattern to vary the operation of the valves associated with the respective bore in the generally open position during the compression stroke when the piston in near the top dead center position. The preestablished logic pattern controllably, sequentially and modulateably actuate the device for unit actuation, moving each of the valves independently between the open and closed position to effectively resist the movement of a piston from a bottom dead center position to a top dead center position.

14 Claims, 2 Drawing Sheets

ENGINE BRAKING UTILIZING UNIT VALVE ACTUATION

TECHNICAL FIELD

The present invention relates generally to the controlled operation of engine operation modes. More particularly, the invention relates to a preestablished logic pattern, each cycle being adaptable to varying the preestablished logic pattern and the preestablished logic pattern controllably, sequentially and modulateably controlling valve timing to provide an engine braking system.

BACKGROUND ART

One such system to provide braking of an engine is disclosed in U.S. Pat. No. 4,592,319 issued on Jun. 3, 1986 to Zdenek S. Meistrick. For example, a compression release device consists of a hydraulic system that opens the exhaust valve near the end of the compression stroke or near top dead center. The compressed air is released through the exhaust system instead of being used to return work to the crankshaft during the expansion stroke. The release of the compressed air also significantly increases turbocharger speed to a level approaching full load fueling. The increase speed provides higher boost thus higher cylinder pressures and increased braking.

Another system to provide braking of an engine is disclosed in U.S. Pat. No. 4,981,119 issued on Jan. 1, 1991 to Alfred Neitz et al. The patent discloses a method of increasing the exhaust braking power of a four-stroke engine. For example, during a first and third stroke air is drawn in via an intake valve, and in a second and fourth stroke the air is compressed and, by partially opening an exhaust valve, is discharged against a damper that is disposed in an exhaust pipe or manifold. In order to increase the final compression pressure or to increase the energy that is to be applied for the compression, the exhaust valve is briefly opened at both the beginning and the end of the compression stroke. The patent fails to disclose or teach a mechanism which will accomplish the increased exhaust braking as claimed.

Utilization of the engine to provide braking is currently done by several methods. All of these methods require additional hardware to be added to the engine, increased customer cost and the greater possibility of hardware failure due to the increased number of components.

The present invention is directed to overcome one or more of the problems as set forth above.

DISCLOSURE OF THE INVENTION

In one aspect of the invention, a braking system is adapted for use with an engine including a passage, a pair of bores and a piston positioned in each of the bores. The piston, during operation of the engine, is movably position within the bores between a top dead center position and a bottom dead center position forming an intake stroke and the reciprocal movement of the piston forming a compression stroke. A pair of valves are operatively associated with each of the bores, interposed the passage and the respective bores and have a closed position and an open position. A means for opening each of the valves independently in response to receiving a control signal and an electronic control system is connected to the opening means. The control signals are outputted to the opening means in a first predetermined logic pattern during normal engine operation. During normal engine operation, each of the pair of valves are closed during the compression stroke. A brake control means is connected to the electronic control system and causes discrete control signals to be outputted to the opening means in a second predetermined logic pattern. The second predetermined logic pattern varies the operation of the valves. This variation causes one of the pair of valves associated with the respective bore to be in the generally open position during the compression stroke when the piston is near the top dead center position.

In another aspect of the invention an engine has a passage, a pair of bores and a pair of piston. During operation of the engine, the pistons are movably positioned within respective bores between a top dead center position and a bottom dead center position forming an intake stroke and the reciprocal movement of the piston forming a compression stroke. A pair of valves are operatively associated with each of the bores, interposed the passage and the respective bores and have a closed position and an open position. A means for opening each of the valves independently in response to receiving a control signal and an electronic control system is connected to the opening means. The control signals are outputting to the opening means in a first predetermined logic pattern during normal engine operation. During the first predetermined logic the pair of valves are closed during the compression stroke. A brake control means is connected to the electronic control system and causes discrete control signals to be outputted to the opening means in a second predetermined logic pattern. The second predetermined logic pattern varies the operation of the valves. This variation causes one of the pair of valves associated with the respective bore to be in the generally open position during the compression stroke when the piston is near the top dead center position.

BEST MODE FOR CARRYING OUT THE INVENTION

Figure 1:
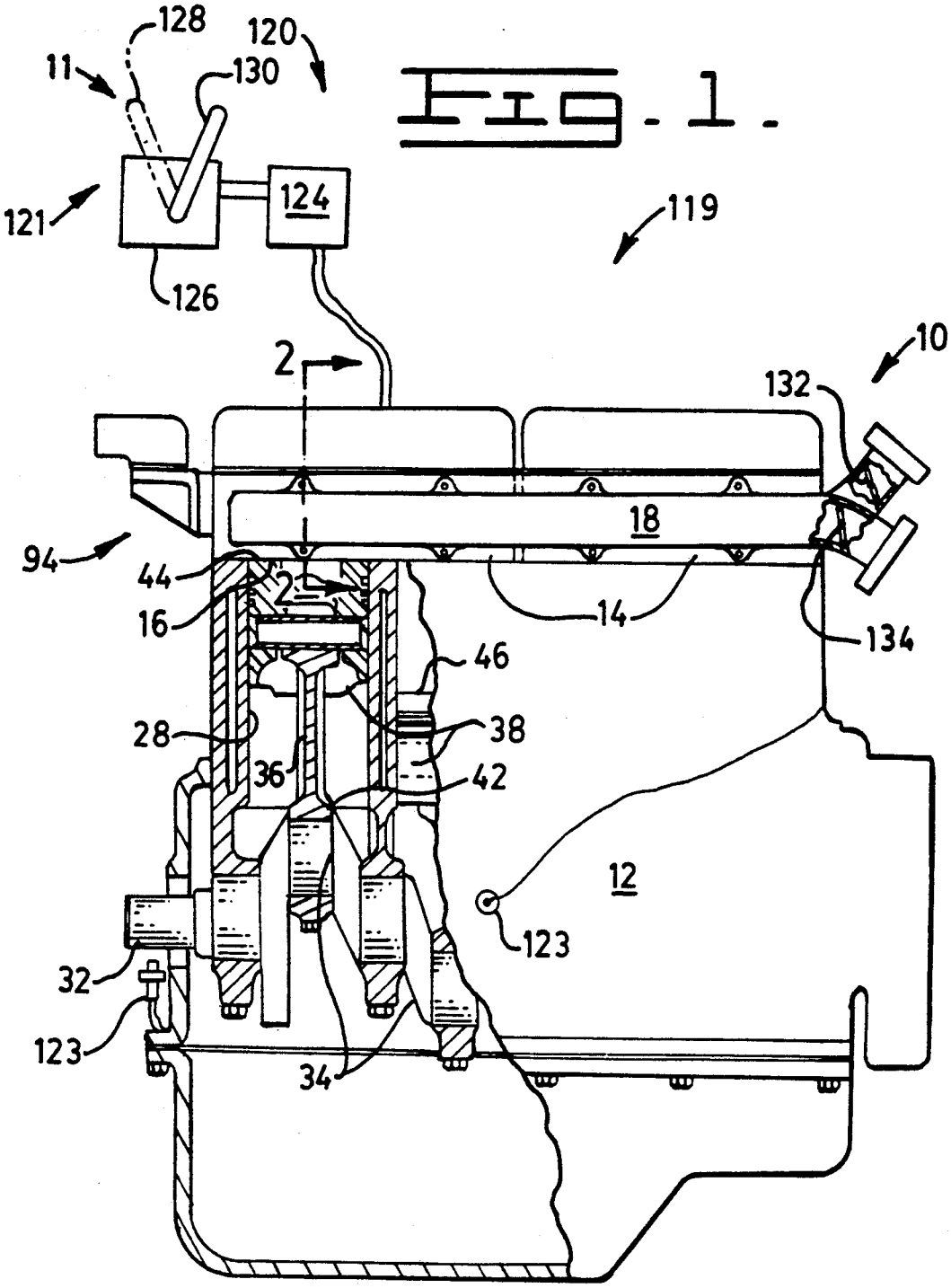
FIG. 1 is a partially sectioned side view of an engine having an embodiment of the present invention.

Referring to FIG. 1, an internal combustion engine 10 having a conventional four cycles of compression, expansion, exhaust and intake strokes includes a braking system 11 which has been adapted for use with the engine 10. The engine 10 includes a block 12 and a plurality of cylinder heads 14 rigidly attached to the block 12. A single cylinder head 14 could be used without changing the gist of the invention. Furthermore, the block 12 and the cylinder head could be of an integral design. Each of the cylinder heads includes a combustion surface 16 defined thereon. An intake manifold 18 is attached to a mounting face 20 of each cylinder head 14 and an exhaust manifold 22 is attached to a mounting face 23 of each cylinder head 14.

The block 12 includes a top face 26 having a plurality of machined cylinder bores 28 therein, of which only a pair is shown. As an alternative, the block 12 could include a plurality of replaceable cylinder liners, not shown, positioned within the bores 28, without changing the gist of the invention. A crankshaft 32 having a plurality of throws 34 thereon is rotatably positioned within the block 12 in a conventional manner. A plurality of connecting rods 36 are rotatably attached to the crankshaft 32 and to a plurality of pistons 38 in a conventional manner. Each of the pistons 38, in this application, is of a single piece design. The pistons 38 could be of an articulated type design without changing the gist of the invention. Each piston 38 and a portion of the connecting rod 36 attached thereto are positioned within a respective bore 28 in a conventional manner. Rotation of the crankshaft 32 causes individual throws 34 to move the piston 38 within the bore 28 a preestablished distance. Rotation of the crankshaft 32 causes the piston 38 to move toward the combustion surface 16 of the cylinder head 14 and further rotation of the crankshaft throw 34 causes the piston 38 to move away from the combustion surface 16. As the throw 34 reaches an apex 42 of rotation, the piston 38 is at a top dead center (TDC) position 44. Subsequently, as the throw 34 reaches a position 180 degrees from the apex 42 the piston 38 is at a bottom dead center (BDC) position 46. Each combination of the throw 34, connecting rod 32 and piston 38 follow a similar path.

Figure 2:
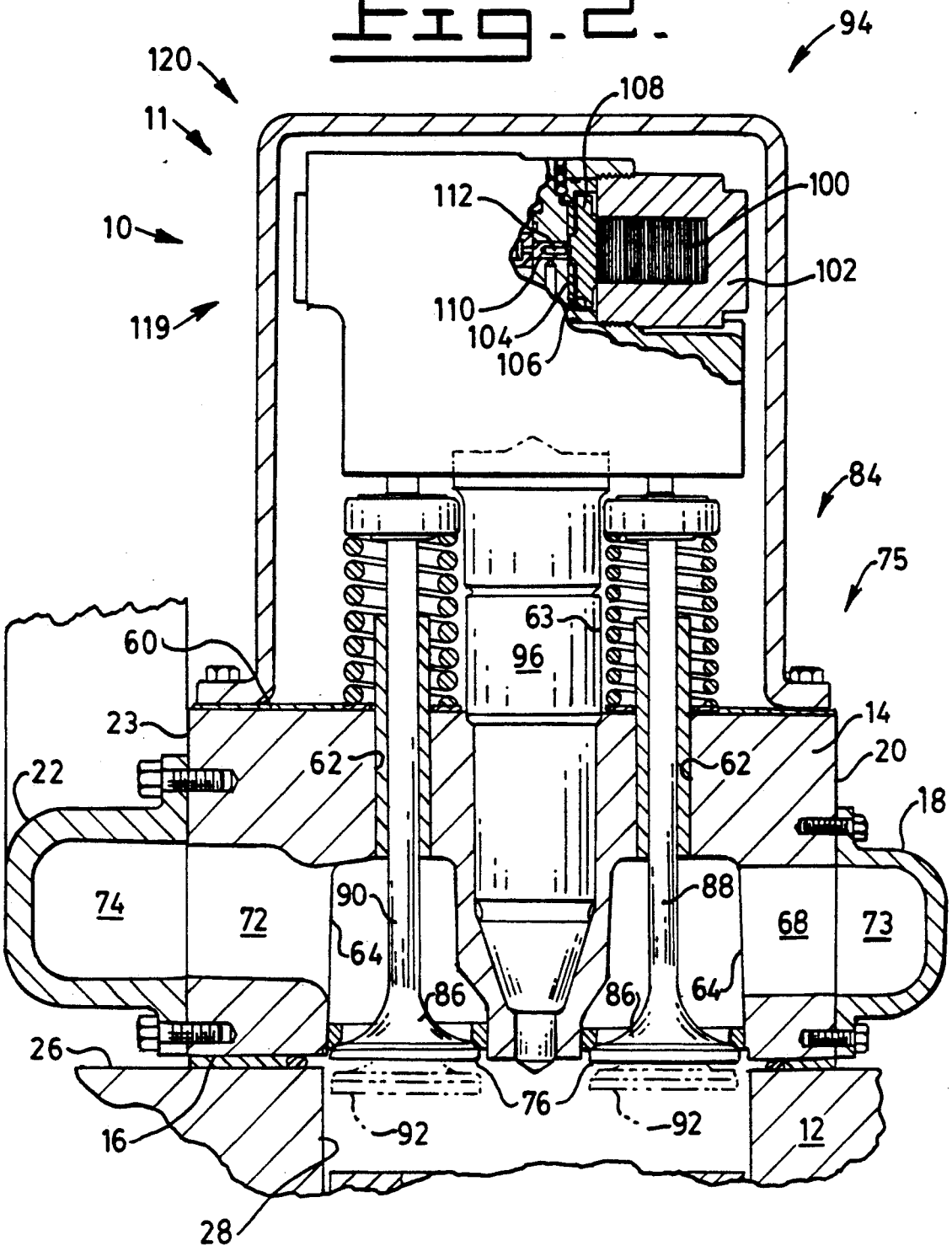
FIG. 2 is a partially section view taken along lines 2—2 of FIG. 1.

As best shown in FIG. 2, the cylinder head 14 further includes a top deck 60 spaced from the combustion surface 16 a preestablished distance. A plurality of valve bores 62 axially extend between the top deck 60 and the combustion surface 16 and a plurality of injector bores 63 axially extend between the top deck and the combustion surface 16. The plurality of valve bores 62 have an enlarged portion 64 extending from the combustion surface 16 toward the top deck 60 a predetermined distance. A plurality of intake passages 68 are positioned within the head 14 and communicate between one of the enlarged portions 64 and the mounting face 20 in a conventional manner. Further positioned within the head 14 are a plurality of exhaust passages 72 which communicate between one of the enlarged portions 64 and the mounting face 23. The intake passages 68 are in fluid communication with an intake manifold passage 73 positioned in the intake manifold 18 and the exhaust passages 72 are in fluid communication with an exhaust manifold passage 74 positioned in the exhaust manifold 22.

A cylinder head assembly 75 includes a pair of valves 76 positioned within the plurality of bores 62 and are removably attached within the cylinder head 16 in a conventional manner. Each of the pair of valves 76, in the assembled position, is retained in sealing contact with the head 16 by a conventional spring means 84 and defines a closed position 86 a first one of the pair of valves 76 are intake valve 88 and another one of the pair of valves 76 are exhaust valves 90. The pair of valves could include a single intake and exhaust valve 88,90 or a combination of multi intake and exhaust valves 88,90. Each of the pair of valves 76 is moved independently into an open position 92 by a means 94 for electronically opening each of the valves 76. In the open position 92, the volume within the bore 28 is in fluid communication with at least one of the intake passages 68 and the intake manifold passage 73, or the exhaust passages 72 and the exhaust manifold passage 74. Positioned within each of the injector bores 63 is a unit fuel injector 96 of a conventional design. The unit fuel injector 96 is also opened by the means 94 for opening. As an alternative, any conventional fuel system could be used with the engine 10 and cylinder head assembly 75.

In a preferred embodiment, the means 94 for opening each of the valves 76 independently includes a like number of piezoelectric motors 100, only one shown, although it could be one of any number of types such as solenoids, voice coils, or linear displaceable electromagnetic assemblies. The piezoelectric motor 100, which is well-known in the art, expands linearly responsive to electrical excitation by a preestablished quantity of energy and contracts when the electrical excitation is ended. Variations in the amount of electrical excitation will cause a similar variation in the linear expansion of the motor 100. For example, full electrical excitation will linearly move a greater distance than half electrical excitation. In the above example, the ratio of distance moved being approximately 2 to 1. The motor 100 is housed in a piezo-housing 102. Adjacent the piezo-housing 102 is a piston housing 104 having a stepped cavity 106 in which are positioned a driver piston 108, an amplifier piston 110, and a fluid chamber 112 therebetween.

The piezoelectric motor 100 can generate high force in the linear direction, however, its linear expansion is much less than the linear displacement required to move the pair of valves 76 from the closed position 86 to the open position 92. Therefore, the driver piston 108, amplifier piston 110 and fluid chamber 112 are provided to translate and amplify linear displacement of the motor 100 into linear displacement in the following manner. The amplifier piston 110 is sized much smaller than the driver piston 108 because the hydraulic amplification ratio of the linear displacement of the driver piston 108 as it relates to the linear displacement of the amplifier piston 110 is inversely proportional to the surface area ratio of the driver piston 108 to the amplifier piston 110. Thus, small linear displacement of the motor 100 is amplified to produce significantly greater linear displacement of the amplifier piston An electronic control system 119 is connected to the opening means 94 and has a control signal 120 directed therefrom to the opening means 94 to functionally control the engine 10 in a first predetermined logic pattern in which each of the pair of valves 76 are closed during the compression stroke.

The braking system 11 includes a brake control means 121 for causing the control signals to be outputted to the opening means 94 in a second predetermined logic pattern different than the first predetermined logic pattern, thus forming a braking mode. The brake control means 121 includes the electronic control system 119, the modified control signal 120, a plurality of engine sensors 123 which relay information concerning the operating conditions of the engine 10, for example, temperature, rpm's, load, air-fuel mixture, etc. in a conventional manner such as by wires or radio type signals, to a microprocessor 124. The microprocessor 124 uses a preprogrammed logic to process the data provided by the sensors 123 and based upon the results of the analysis outputs the control signal 120 to supply current to the various piezoelectric motors 100. The motors 100 are actuated independently of each other and thus, the intake valves 88, exhaust valves 90 and unit fuel injectors 96 are independently controlled so as to produce optimum timing events of valve opening and fuel injection for various engine 10 operating conditions.

The brake control means 121 for causing the control signal 120 to be outputted to the opening means 94 further includes a device 126 which is movable between an off position 128 and a fully on position 130. In this application, the device 126 is movable between the off position 128 and the fully on position 130 in an infinitely variable number of positions. As an alternative, the device 126 could be movable between the off position 128 and the fully on position 130 in a series of predetermined positions. For example, the device 126 could be positioned in a series of one-eight incremented positions between the off position 128 through the fully on position 130.

Experimentation has shown that timing or crankshaft 32 rotational position at which the compression air within the bore 28 is released has an effect on the braking system 11. Thus, the individual operation of the opening means 94 which unit actuates each of the pair of valves 76 can be further utilized. Experimentation has shown that the braking is maximized when the exhaust valve 90 is opened before TDC. For example, due to the finite time it takes the compressed air to leave the bore 28, to prevent expansion work from being done, the timing of the valve 90 opening is critical to efficiently increase braking effectiveness. Braking effectiveness can further be increased by controlling the position of the valve lift between the closed position 86 and the fully open position 92. The increased lift of the valve 90 allows the evacuation of the fluid, which in this application is compressed air, within the cylinder in a shorter time. Computer simulation has shown that increased lift does, however, have a limitation. In the above experiment, a valve lift of about 2 mm showed a significant increase in the evacuation of the fluid within the bore 28 over a valve lift of about 1 mm. Computer simulation has further shown that the rate of evacuation through the opening provided by a valve lift of about 3 mm increased rather slowly in comparison to the increase of evacuation between the 1 mm and the 2 mm valve lift.

In another mode of operation, the braking system 11 effectiveness can be further increased by utilizing the opening means 94. In this mode, the effectiveness is increased by increasing the losses during the exhaust stroke by restricting the flow through the valve 90. The unit actuation of each of the pair of valves 76 allows this to be accomplished. For example, the exhaust valve 90 is moved into a position intermediate the closed position 86 and the fully open position 92 for the compression release during the would be expansion and exhaust strokes. Thus, the small exhaust valve lift causes increased pressure, absorbing energy, causing resistance to build during the exhaust stroke creating more braking effectiveness.

The braking system 11 effectiveness can be further increased with the unit actuation of the pair of valves 76 independently by utilizing a dual compression release mode. For example, in a conventional four cycle engine the braking effort can be significantly increased if during each revolution of the crankshaft 32 the compression release is activated. In this mode, the unit actuation of the pair of valves 76 provides an intake process and compression release during each revolution versus only the conventional single compression stroke in the conventional four cycle.

Furthermore, the braking system 11 effectiveness can be increased by utilizing the unit actuation of the pair of valves 76 independently by using a dual compression release, exhaust back fill and exhaust restriction mode. For example, this mode will require an additional exhaust restriction device 132. The restriction device 132 is positioned within the exhaust manifold passage 74 intermediate the exhaust passages 72 and an exit from the exhaust manifold 22. The restrictor device 132 could be of a conventional design such as a flapper valve or a pendulum valve. In this mode, the braking system 11 effectiveness can be improved by combining the device 132 and the opening means 94 when used to unit actuate each of the pair of valves 76 independently to act as a compression release. With the device 132 engaged, a higher pressure would be developed within the exhaust manifold passage 74 than within the intake manifold passage 73 and each of the bores 28 would be back filled from the exhaust manifold passage 74. By filling the bores 28 with higher pressure, the compression work and braking effort increases. The increase in braking capability of the bores 28 is limited by the ability of the bores 28 to back fill. The design of the manifold will influence the ability to maximize exhaust backfilling.

The brake control means 121 further includes the pair of valves 76, one of the intake passages 68 and the exhaust passage 72, the pair of bores 28 and the pistons 38.

INDUSTRIAL APPLICABILITY

In use, the engine utilizes the opening means 94 to unit actuate each of the valves 76 independently. The opening means 94 allows the freedom to change timing of the pair of valve 76 events independently of crankshaft 32 rotational position. The opening means 90 having the ability to actuate each pair of valves 76 independently and the valve timing flexibility allows for better modulation of the braking system 11. For example in operation, an operator engages the brake control means 12 activating the brake system 11 and the piston 38 moves toward the compression surface 16, during the compression cycle, compressing the volume of air trapped within the bore 28. Slightly before, in this application approximately 20 degrees, the (TDC) position the exhaust valve 90 corresponding to the respective bore 28 is moved into the fully open position 92. The compressed air within the bore 28 is released into the exhaust passage 72 and communicates with the exhaust manifold passage 74. The release of the compressed air into the exhaust manifold 22 significantly increases turbocharger speed. The increased speed provides higher boost in the intake manifold passage 73, thus, higher cylinder pressures during the compression cycle, requiring greater energy to compress the volume of air within the adjacent bore 28 and effectively engaging the braking system 11. The freedom in valve timing allows duplication of the compression release by adjacent bores 28 further increasing the volume of air and further increasing the energy required to compress the volume of air effectively boosting the braking capability of the braking system 11. Functionally, when in use the braking system 11 has pressure built up during the compression stroke which requires work input to the engine 10 that is not recovered during the expansion stroke due to the compression release.

Alternate modes such as varying the lift or position of the valve 90 between the closed position 86 and the fully open position 92, progressively releasing concurrent cylinder during the compression stroke or dual compression release and dual compression release combined with an exhaust back fill and exhaust restriction will increase the effectiveness of the braking system 11.

Another alternate mode such as opening the intake valve 88 during the compression stroke and releasing the compressed air into the intake passage 73 to be introduced into an adjacent cylinder bore 28 during the intake stroke will further increase boost in the intake manifold passage 73, thus, higher cylinder pressures during the compression cycle, requiring greater energy to compress the volume of air within the adjacent bore 28 and effectively braking the engine 10. It is theorized that this mode may require a one way valve 134 near the fluid inlet end of the intake manifold 18 to prevent a flow out of the intake passage 73. This alternative would primarily be used with a naturally aspirated engine 10. However, this alternative could be adapted for use with a turbocharged or supercharged engine 10.

The control of valve timing to maximize braking will require controlling such things as air flow or turbocharger speed within structural limitations.

The present invention provides an efficient and cost effective braking system 11 without the addition of expensive mechanical mechanism. The electronic control system 119 can be utilized to activate the opening means 94 to vary the conventional first predetermined logic pattern and provide a braking mode. The individual actuation of the pair of valves 76 makes it possible to control the opening position 92, closing position 86, and the lift of each position 92,86 of the valves 76 independently of the crankshaft 32 angle. Thus, a more efficient cost effective braking system 11 can be utilized.

Other aspects objects and advantages of this invention can be obtained from a study of the drawing, the disclosure and the appended claims.

We claim:

1. A braking system adapted for use with an engine including an exhaust passage, a pair of bores, a piston during operation of the engine being movably positioned within respective bores between a top dead center position and a bottom dead center position forming an intake stroke and the reciprocal movement of the piston forming a compression stroke;

a pair of valves each being operatively associated with each of the bores, interposed the exhaust passage and the respective bores and having a closed position and an open position;

means for opening each of the valves independently in response to receiving a control signal;

an electronic control system connected to the opening means and outputting the control signals to the opening means in a first predetermined logic pattern during normal engine operation wherein each of said pair of valves are closed during the compression stroke;

brake control means connected to the electronic control system for causing discrete control signals to be outputted to the opening means in a second predetermined logic pattern to vary the operation of the valves so that one of each pair of valves associated with the respective bores is in the generally open position during the compression stroke when the piston is near the top dead center position, said discrete control signal to the opening means causing the respective valve to move to the open position increasing the fluid pressure in the exhaust passage and said discrete control signal to the opening means causing the respective valve to move to the open position when the piston is in the intake stroke and the increased fluid pressure in the exhaust passage enters into the respective bore.

2. The braking system of claim 1 further including a turbocharger positioned within the exhaust passage wherein said increased fluid pressure in the exhaust passage causing the turbocharger to increase in speed and increasing the fluid pressure within the intake passage.

3. The braking system of claim 1 wherein said exhaust passage includes an exit and said system includes a restrictor device positioned within the exhaust passage blocking and exit and further increasing the fluid pressure within the exhaust passage.

4. The braking system of claim 1 wherein said opening means includes a piezoelectric motor.

5. The braking system of claim 1 wherein said opening means independently opens the valves to a preestablished lift position wherein the valves are at the open position.

6. The braking system of claim 1 wherein said opening means independently opens the valves to a preestablished lift position intermediate the closed position and the open position.

7. An engine having an intake passage, an exhaust passage, a pair of bores, a piston during operation of the engine being movably positioned within respective bores between a top dead center position and a bottom dead center position forming an intake stroke and the reciprocal movement of the piston forming a compression stroke, a pair of valves operatively associated with each of the bores, interposed the passage and the respective bores and having a closed position and an open position, means for opening each of the valves independently in response to receiving a control signal, an electronic control system connected to the opening means and outputting the control signals to be outputted to the opening means in a first predetermined logic pattern during normal engine operation wherein each of said pair of valves are closed during the compression stroke, characterized in that; brake control means being connected to the electronic control system for causing discrete control signals to be outputted to the opening means in a second predetermined logic pattern to vary the operation of the valves so that one of each pair of valves associated with the respective bore is in the generally open position during the compression stroke when the piston is near the top dead center position, said discrete control signal to the opening means causing the respective valve to move to the open position when the piston is in the intake stroke and the increased fluid pressure in one of the exhaust passage and the intake passage enters into the respective bore.

8. The engine of claim 7 further including a turbocharger positioned within the exhaust passage wherein said increased fluid pressure in the exhaust passage causing the turbocharger to increase in speed and increasing the fluid pressure within the intake passage.

9. The engine of claim 7 wherein said discrete control signal to the opening means causing the respective valve to move to the open position when the piston is in the intake stroke and the increased fluid pressure in the exhaust passage enters into the respective bore.

10. The engine of claim 9 wherein said exhaust passage includes an exit and said system includes a restrictor device positioned within the exhaust passage blocking the exit and further increasing the fluid pressure within the exhaust passage.

11. The engine of claim 7 wherein said opening means includes a piezoelectric motor.

12. The engine of claim 7 wherein said opening means independently opens the valves to a preestablished lift position wherein the valves are at the open position.

13. The engine of claim 7 wherein said opening means independently opens the valves to a preestablished lift position intermediate the closed position and the open position.

14. The engine of claim 7 wherein said intake passage includes a fluid inlet end and said system includes a device positioned within the intake passage blocking the exit of fluid and further increasing the fluid pressure within the intake passage.

* * * * *